US007445136B2

(12) United States Patent
Lin

(10) Patent No.: US 7,445,136 B2
(45) Date of Patent: Nov. 4, 2008

(54) VALVE FOR GAS CAN

(76) Inventor: Arlo Lin, No. 68, Kung Yeh 32nd Road, Industrial Park, Taichung (TW)

( * ) Notice: Subject to any disclaimer, the term of this patent is extended or adjusted under 35 U.S.C. 154(b) by 485 days.

(21) Appl. No.: 11/307,997

(22) Filed: Mar. 2, 2006

(65) Prior Publication Data

US 2007/0205228 A1 Sep. 6, 2007

(51) Int. Cl.
*B65D 83/00* (2006.01)

(52) U.S. Cl. ..... 222/402.1; 222/402.13; 222/402.14

(58) Field of Classification Search ..... 222/402.13, 222/402.14, 402.24, 402.2, 322, 402.11, 222/182, 402.1–9; 169/71
See application file for complete search history.

(56) References Cited

U.S. PATENT DOCUMENTS 2,000,493 A * 5/1935 Miller ..... 222/205
3,913,609 A * 10/1975 Remane ..... 137/322
4,289,039 A * 9/1981 Trunner et al. ..... 74/2
4,453,650 A * 6/1984 Witte et al. ..... 222/43
4,577,784 A * 3/1986 Brunet ..... 222/402.2
5,082,652 A * 1/1992 Mayfield et al. ..... 424/47
5,115,944 A * 5/1992 Nikolich ..... 222/94
5,636,769 A * 6/1997 Willingham ..... 222/400.7
5,901,907 A * 5/1999 Hildebrandt ..... 239/337
6,050,457 A * 4/2000 Arnold et al. ..... 222/321.9
6,302,297 B1 * 10/2001 Richardson et al. ..... 222/1
6,789,702 B2 * 9/2004 O'Connor et al. ..... 222/96
6,802,461 B2 * 10/2004 Schneider ..... 239/337
6,824,079 B2 * 11/2004 Kendrick et al. ..... 239/343
2003/0136802 A1 * 7/2003 Di Giovanni et al. .... 222/402.1
2004/0226966 A1 * 11/2004 Carlucci et al. ..... 222/146.5

* cited by examiner

*Primary Examiner*—George Nguyen
*Assistant Examiner*—Michael Hagedorn
(74) *Attorney, Agent, or Firm*—Alan Kamrath; Kamrath & Associates PA

(57) ABSTRACT

A valve includes a shell defining a space and an aperture through which gas can go into the space. A tube is movable in the space of the shell between a first position for opening the aperture of the shell and a second position for closing the aperture of the shell. The tube includes a tunnel defined therein and an internal annular flange formed on the wall of the tunnel. A seal is located between the tube and the shell. A spring is compressed between the tube and the shell. A core is located in the tube so as to abut the internal annular flange of the tube in the first position of the tube. A rod is formed on a closed end of the space of the shell so as to push the core from the internal annular flange of the tube in the second position of the tube.

16 Claims, 11 Drawing Sheets

VALVE FOR GAS CAN

BACKGROUND OF INVENTION

1. Field of Invention

The present invention relates to a valve for a gas can.

2. Related Prior Art

Referring to FIGS. 8 and 9, there is shown a conventional valve for a gas can. The valve includes a shell 10' and a core 20'. The shell 10' defines a first space 11' and a second space 16' in communication with the first space 11'. A spring 12' is positioned in the first space 11'. A ring 13' is positioned in the second space 16'. The ring 13' includes an annular flange 14' on an internal side. An annular restraint 15' is positioned in the second space 16'. The core 20' defines a space 21' and an aperture 22' in communication with the space 21'. The core 20' includes a closed end and an open end. Formed on an external side of the core 20' are a first abutment portion 23' and a second abutment portion 24'.

Referring to FIG. 8, the closed end of the core 20' is normally located in the first space 11' of the shell 10' while the abutment portions 23' and 24' of the core 20' are located in the ring 13'. The first abutment portion 23' abuts the annular restraint 15'. The aperture 22' is located outside the second space 16' of the shell 10'. Gas goes into a space ("effective space") between the ring 13' and the abutment portions 23' and 24' of the core 20' from the first space 11' of the shell 10', past the annular flange 14'. The gas does not leave the effective space.

Referring to FIG. 9, to release the gas, the open end of the core 20' is pushed. The second abutment portion 24' of the core 20' contacts the flange 14' so that the gas does not go into the effective space from the first space 11' of the shell 10'. On the other hand, the aperture 22' is moved into the effective space so as to allow the gas to go into the space 21' of the core 20' from the effective space through the aperture 22' of the core 20'. Every time the open end of the core 20' is pushed, a predetermined amount of gas leaves the effective space.

There are problems with this conventional valve. The ring 13' including the flange 14' is made of plastic, and it is difficult to precisely control the dimensions of the ring 13' including the flange 14'. In the case where the flange 14' is made too large, it contacts the second abutment portion 24' of the core 20' even in the normal position so as to prevent the gas from entering the effective space. Thus, in the releasing position, an inadequate amount of gas leaves the effective space. In the case where the flange 14' is made too small, it fails to contact the second abutment portion 24' of the core 20' even in the releasing position, thus allowing the gas to continue to go into the effective space. Hence, an excessive amount of gas leaves the effective space.

Referring to FIGS. 10 and 11, there is shown another conventional valve for a gas can. This conventional valve includes a shell 10", a first tube 20" and a second tube 30". The shell 10" defines a space 11" for receiving the tubes 20" and 30" and a spring. The first tube 20" defines a first tunnel 22" and a second space 23" in communication with the first tunnel 22". The spring is compressed between an internal end of the first tube 20" and the wall of the space 11" of the shell 10". The second tube 30" includes a closed end and an open end. The second tube 30" defines a space 31", an outlet 32" in communication with the space 31" and an intake 33" in communication with the space 31".

Referring to FIG. 10, the closed end and outlet 32" of the second tube 30" are normally located in the second space 23" of the first tube 20". Hence, gas does not go into the first tunnel 22" of the first tube 20".

Referring to FIG. 11, to release the gas, an external end of the first tube 20" is pushed. Thus, the outlet 32" of the second tube 30" is located in the first tunnel 22" of the first tube 20". Hence, the gas goes into the first tunnel 22" of the first tube 20" from the space 31" through the outlet 32" of the second tube 30". Accordingly, the gas leaves the space 11" of the shell 10".

There are problems with this conventional valve. The dimensions of the first tube 20" are predetermined. For insertion into the first tube 20", the second tube 30" must be thin. However, it is difficult to form a thin tube like the second tube 30. It is also difficult to make small holes like the intake 33" and the outlet 32". Moreover, as the outlet 32" is small and might be jammed by the gas so that the valve might release an inadequate amount of gas every time the first tube 20" is pushed.

The present invention is intended to obviate or at least alleviate the problems encountered in prior art.

SUMMARY OF INVENTION

According to the present invention, a valve includes a shell defining a space and an aperture through which gas can go into the space. A tube is movable in the space of the shell between a first position for opening the aperture of the shell and a second position for closing the aperture of the shell. The tube includes a tunnel therein and an internal annular flange on the wall of the tunnel. A seal is located between the tube and the shell. A spring is compressed between the tube and the shell. A core is located in the tube so as to abut the internal annular flange of the tube in the first position of the tube. A rod is formed on a closed end of the space of the shell so as to push the core from the internal annular flange of the tube in the second position of the tube.

An advantage of the valve of the present invention is that it precisely provides a predetermined amount of gas every time the tube is pushed to the second position.

Another advantage of the valve of the present invention is that it can easily be made.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
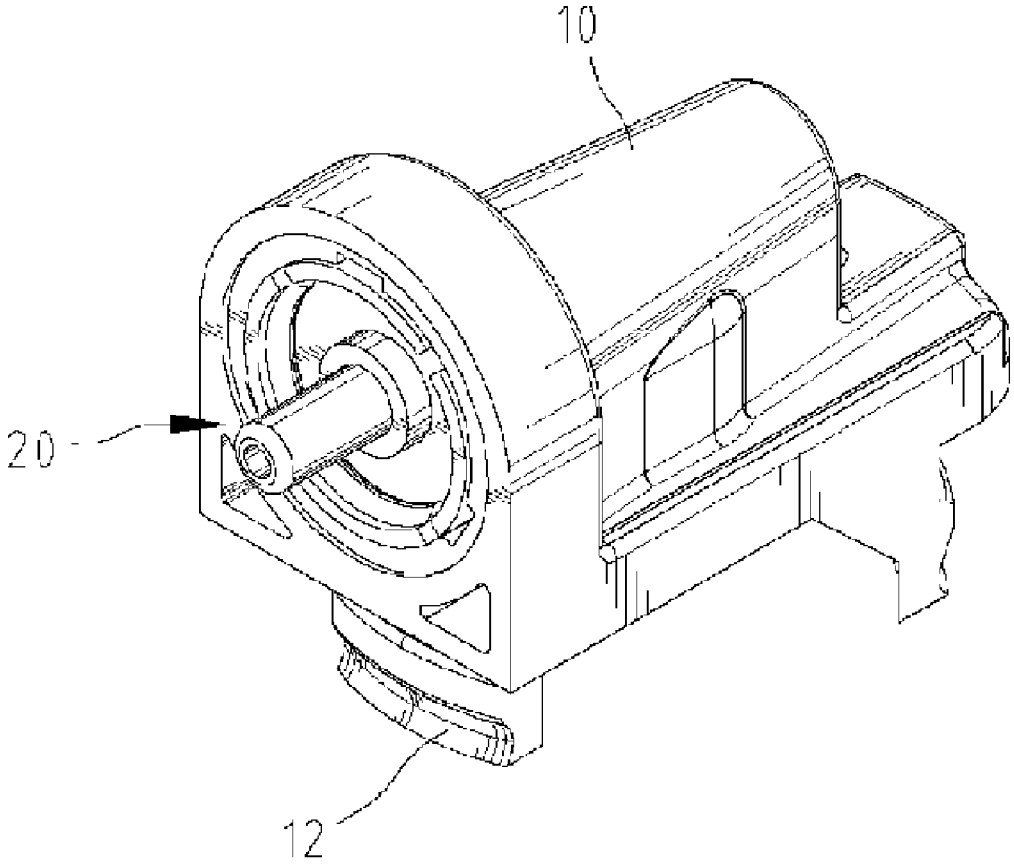
FIG. 1 is a perspective view of a valve in accordance with the preferred embodiment of the present invention.
Figure 2:
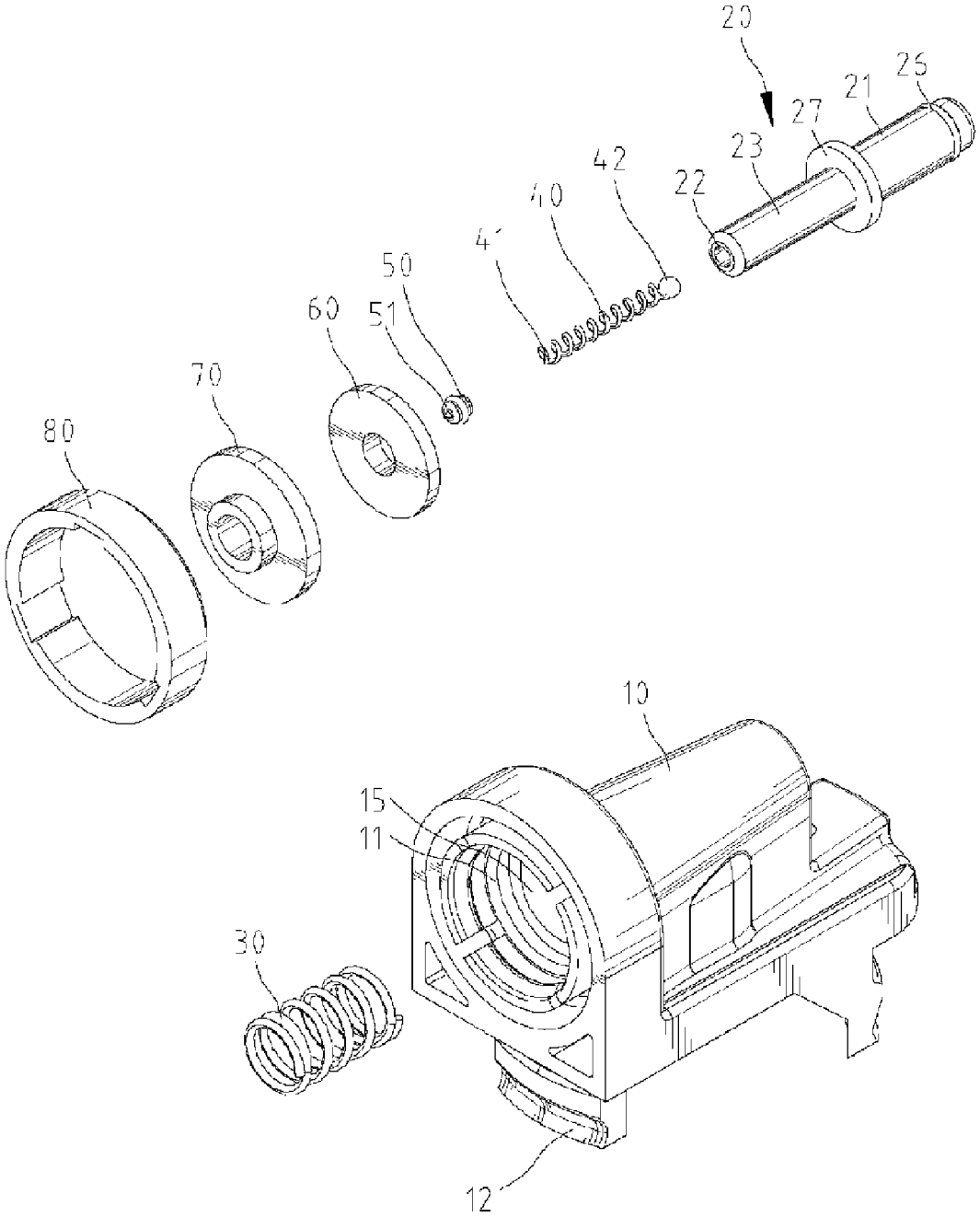
FIG. 2 is an exploded view of the valve shown in FIG. 1.
Figure 3:
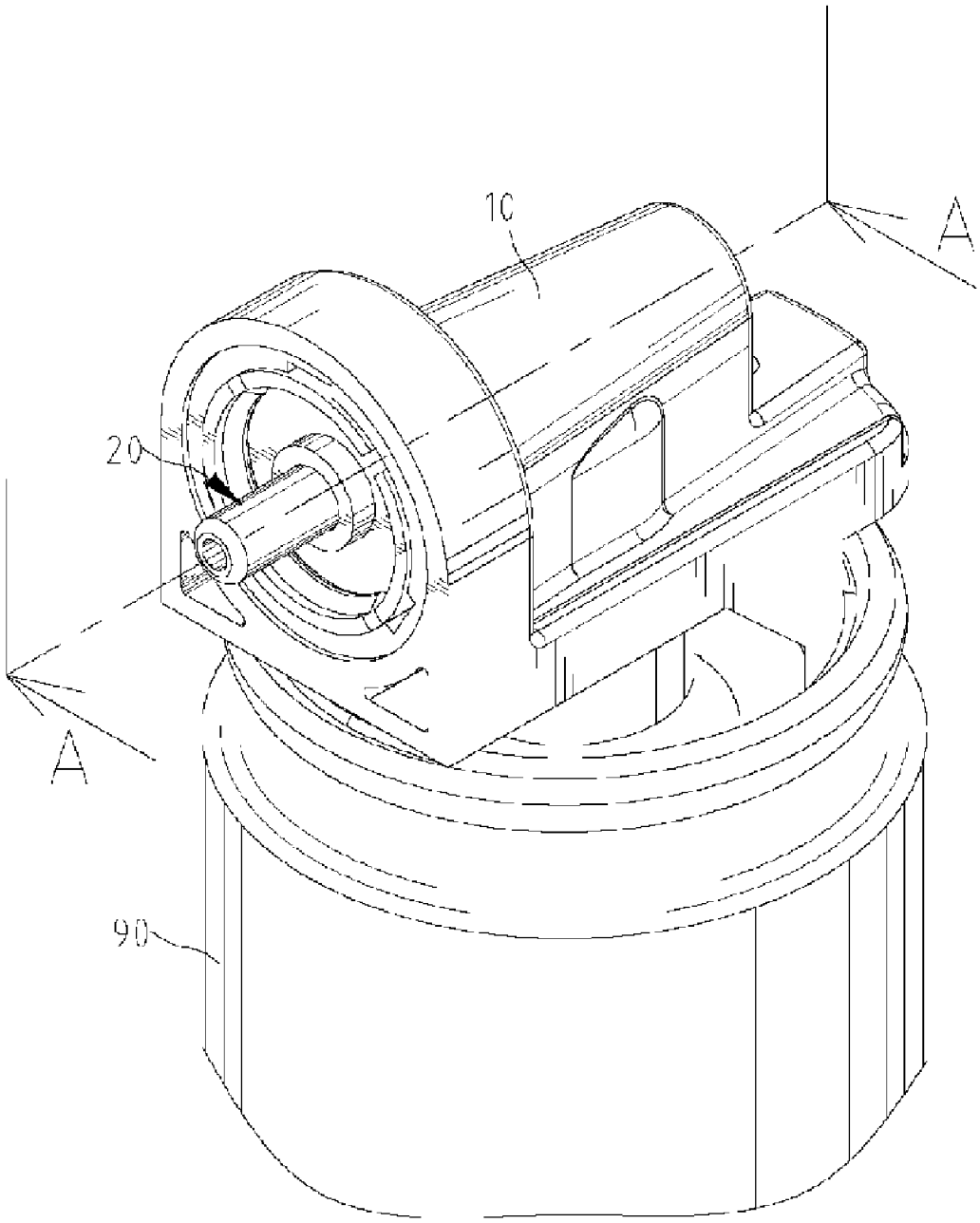
FIG. 3 is an enlarged view of the valve shown in FIG. 1 installed on a gas can.
Figure 4:
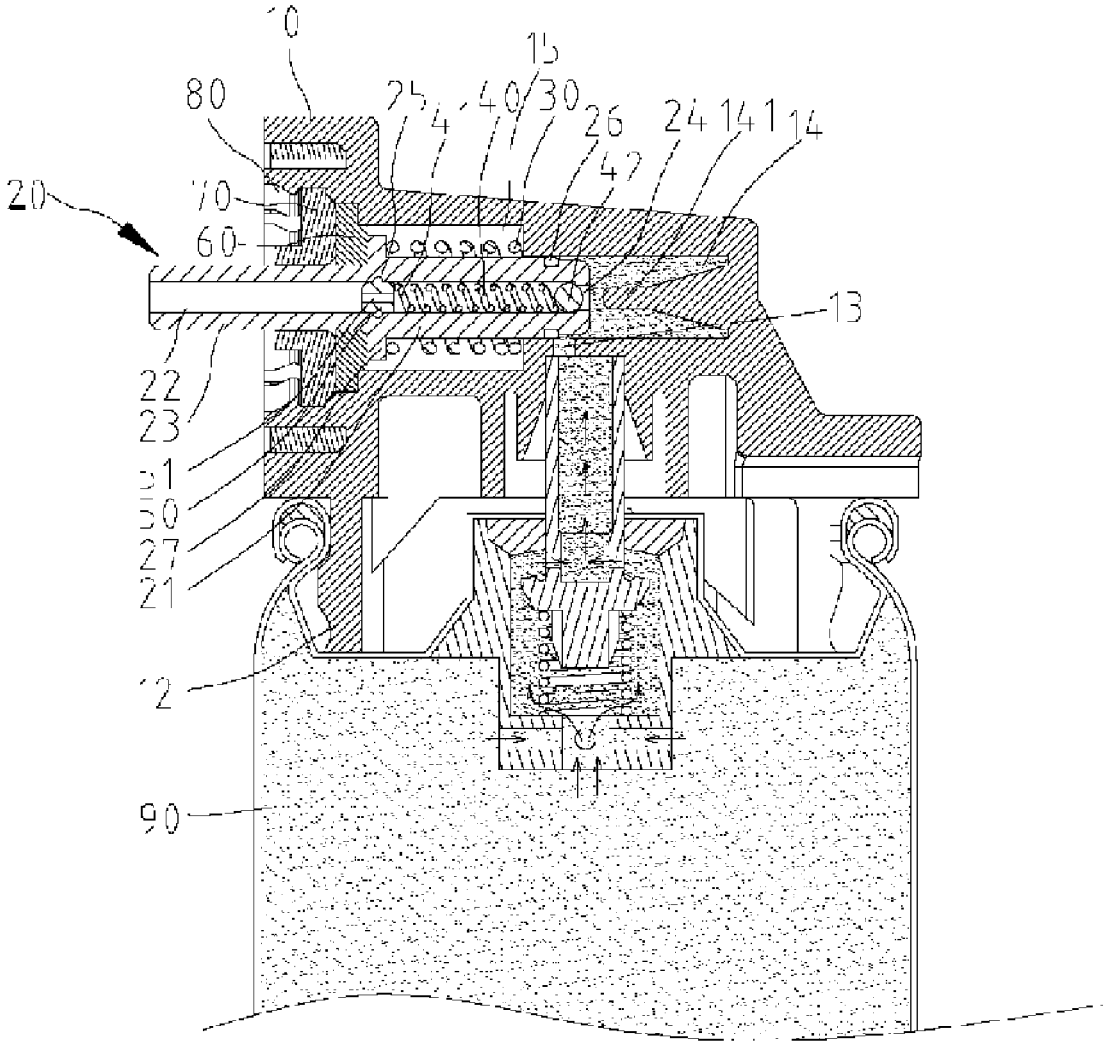
FIG. 4 is a cross-sectional view of the valve taken along a line A-A in FIG. 1.

Referring to FIGS. 1 through 4, there is shown a valve according to the preferred embodiment of the present invention. The valve includes a shell 10, a tube 20, a spring 30, a core 40, an annular restraint 50, an annular seal 60, a washer 70 and an annular restraint 80.

The shell 10 includes an insert 12. The shell 10 defines a space 11 including a first subspace 14 and a second subspace 15. The diameter of the first subspace 14 is smaller than that of the second subspace 15. An aperture 13 is in communication with the first subspace 14. The shell 10 includes a rod 141 projecting from a closed end of the first subspace 14.

The tube 20 includes a first section 21, a second section 23 and an external annular flange 27 on an external side between the first section 21 and the second section 23. Two annular seals 26 are installed on the first section 21 of the tube 20. The tube 20 defines a tunnel 22. The tube 20 includes, on an internal side, an annular flange 24 at an end and an annular groove 25 corresponding to the external annular flange 27.

The core 40 includes a spring 41 and a ball 42 formed at an internal end of the spring 41.

The annular restraint 50 defines an aperture 51 through which the gas can go.

The insert 12 of the shell 10 is fit in a tubular portion of a gas can 90. A portion of the first section 21 of the tube 20 and the annular seals 26 are located in the first subspace 14 of the shell 10. The remaining portion of the first section 21 of the tube 20 and the external annular flange 27 are located in the second subspace 15 of the shell 10. The spring 30 is located in the second subspace 15 of the shell 10 and compressed between the external annular flange 27 and a shoulder formed between the subspaces 15 and 14 of the shell 10. The core 40 is located in the tunnel 22 of the tube 20. The annular restraint 50 is fit in the annular groove 25 of the tube 20 so that the spring 41 is compressed between the annular restraint 50 and the ball 42 and that the ball 42 is pushed to the internal annular flange 24 by means of the spring 41. The annular seal 60, the washer 70 and the annular restraint 80 are located on the second section 23 of the tube 20. The annular restraint 80 is engaged with a portion of the shell 10 so as to keep the valve assembled.

Gas goes into the first subspace 14 from the gas can 90 through the aperture 13. The gas does not go into the tunnel 22 of the tube 20 from the first subspace 14 of the shell 10 since the ball 42 abuts the internal annular flange 24.

Figure 5:
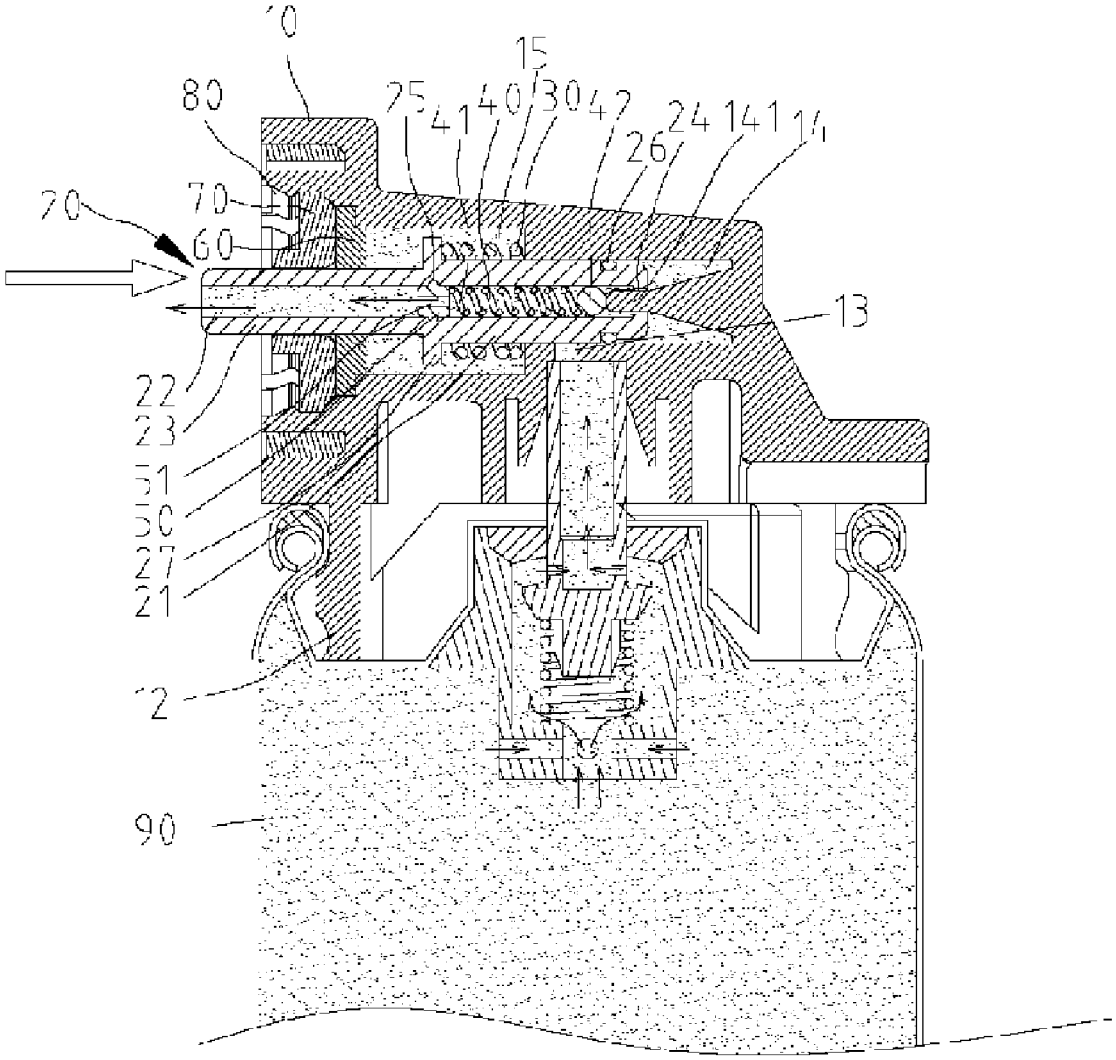
FIG. 5 is a cross-sectional view of the valve taken in another position than shown in FIG. 4.

Referring to FIG. 5, to release the gas, the second section 23 of the tube 20 is pushed. The first section 21 of the tube 20 is moved to the rod 141. The rod 141 enters the tunnel 22 so as to push the ball 42 from the internal annular flange 24. Thus, the gas goes into the tunnel 22 of the tube 20 from the first subspace 14 of the shell 10.

At this instant, the first section 21 of the tube 20 blocks the aperture 13 so as to prevent gas from entering the first subspace 14 of the shell 10.

Figure 6:
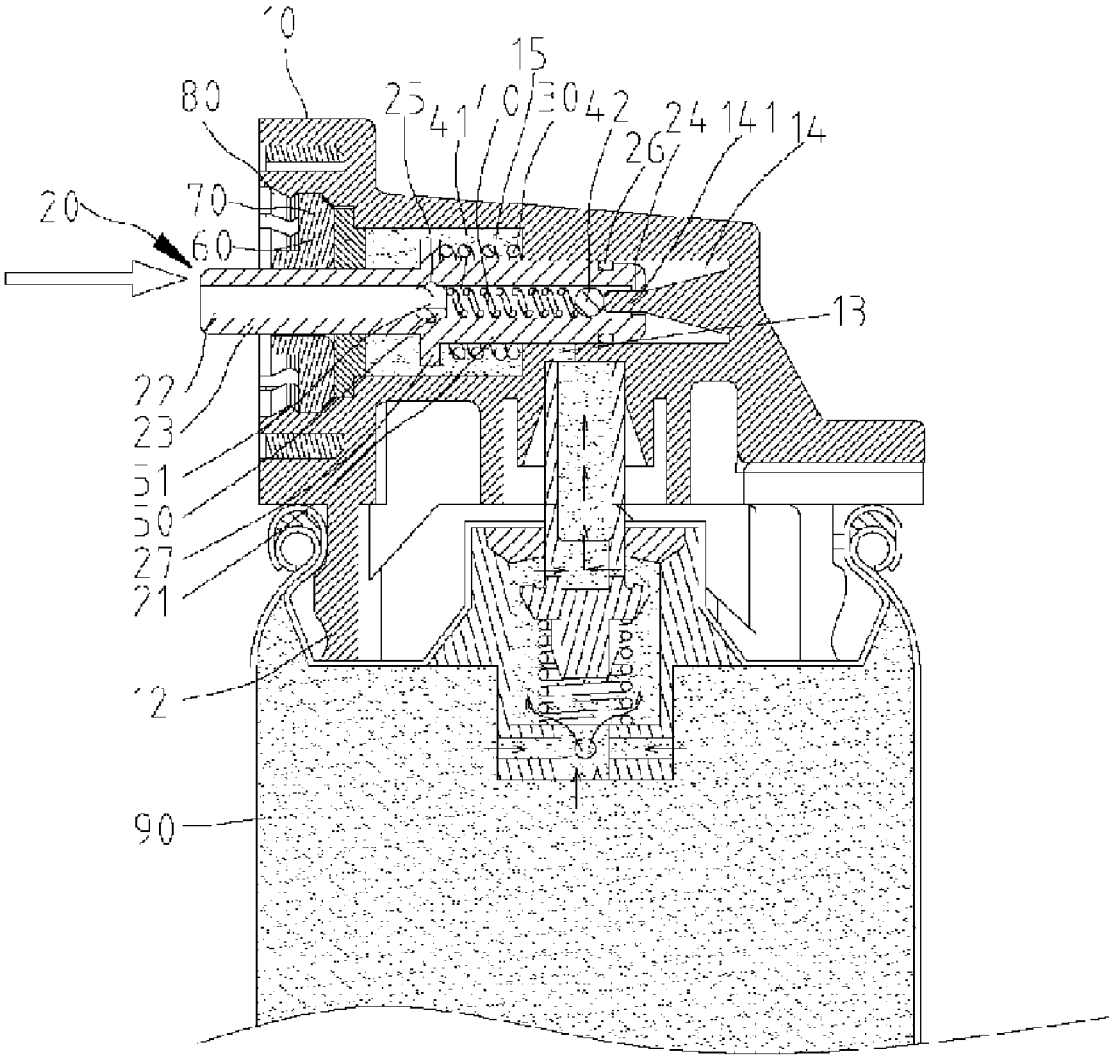
FIG. 6 is a cross-sectional view of the valve taken in another position than shown in FIG. 5.

Referring to FIG. 6, the gas has left the tube 20. The first subspace 14 of the shell 10 is empty of gas.

Figure 7:
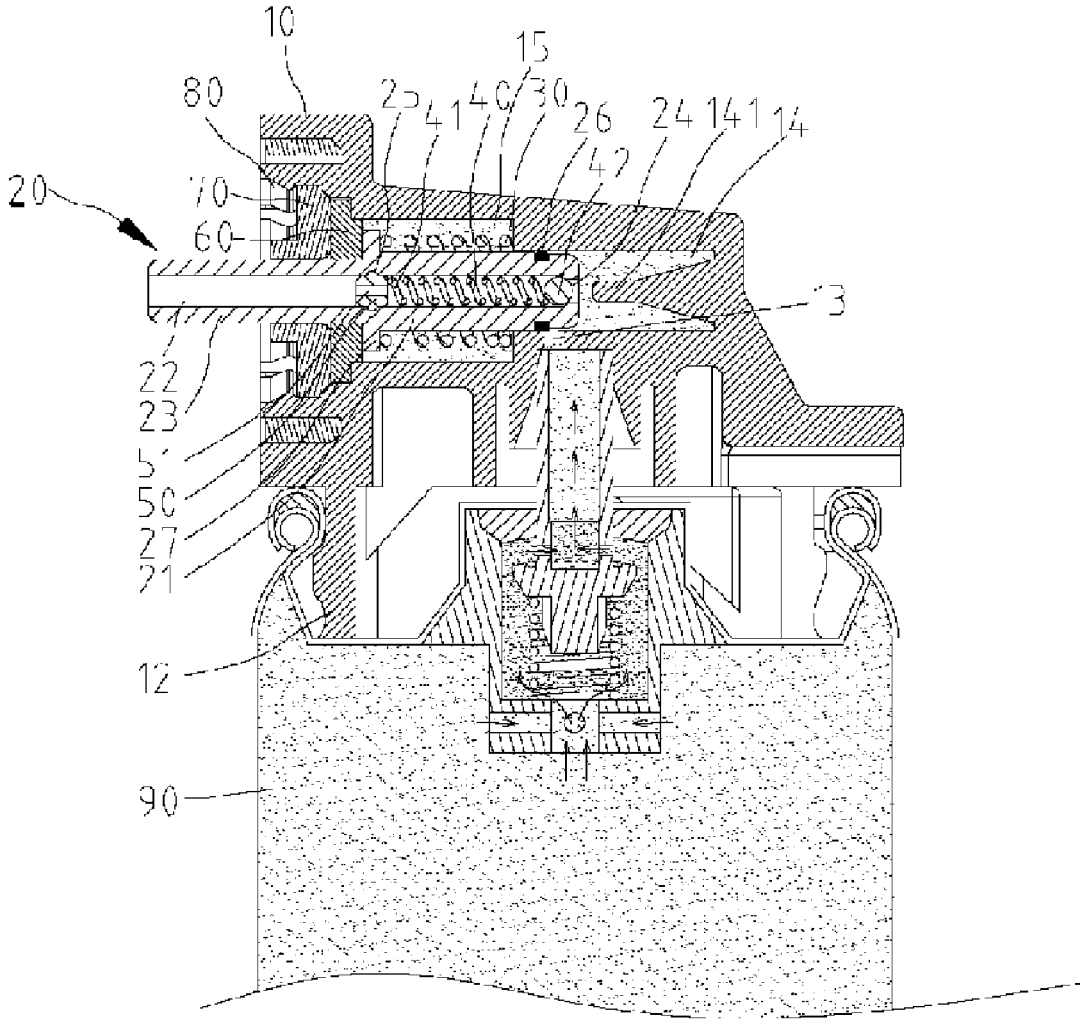
FIG. 7 is a cross-sectional view of the valve taken in another position than shown in FIG. 6.
Figure 8:
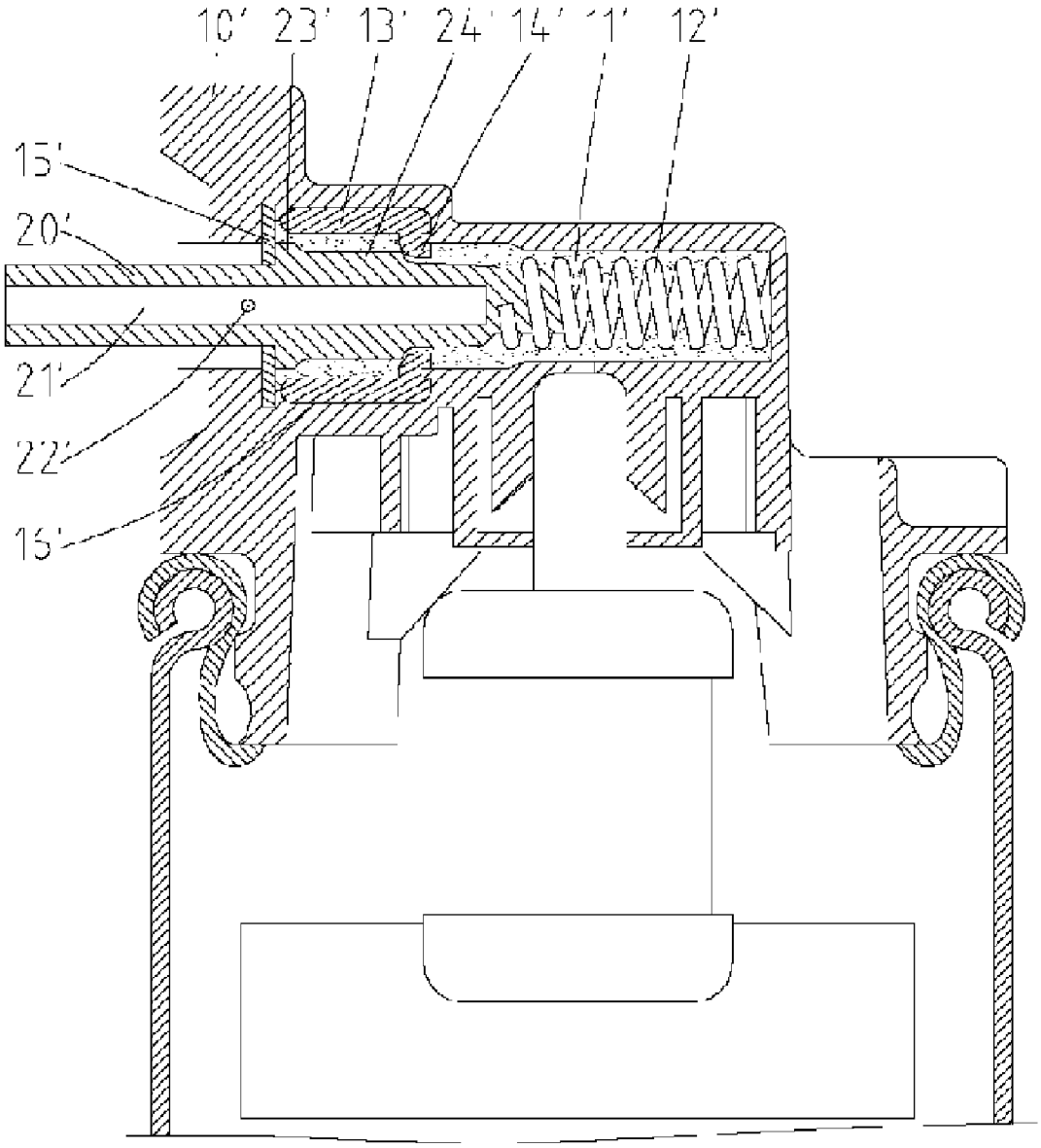
Fig.8 PRIOR ART
FIG. 8 is a cross-sectional view of a conventional valve for a gas can.
Figure 9:
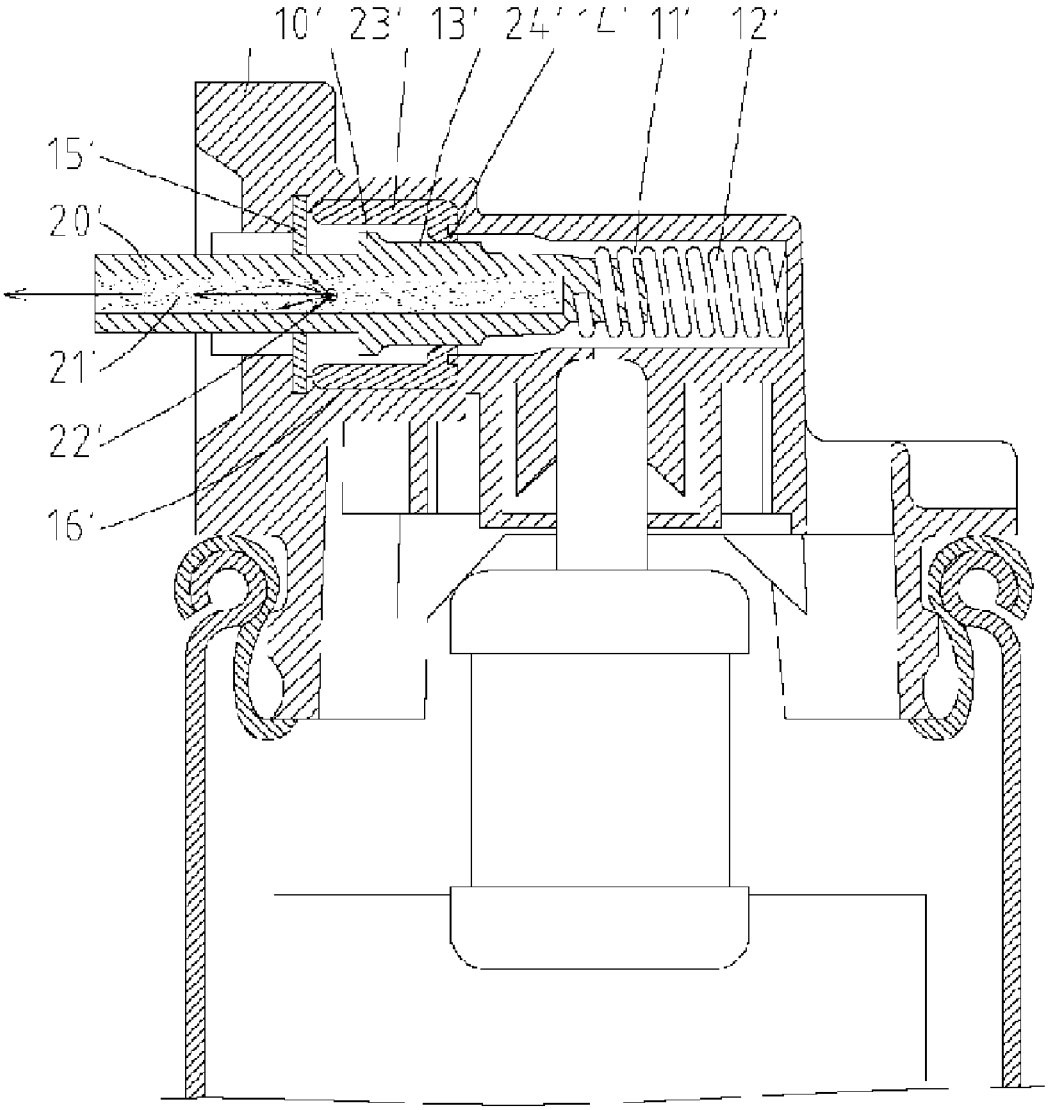
Fig.9 PRIOR ART
FIG. 9 is a cross-sectional view of the valve taken in another position than shown in FIG. 8.
Figure 10:
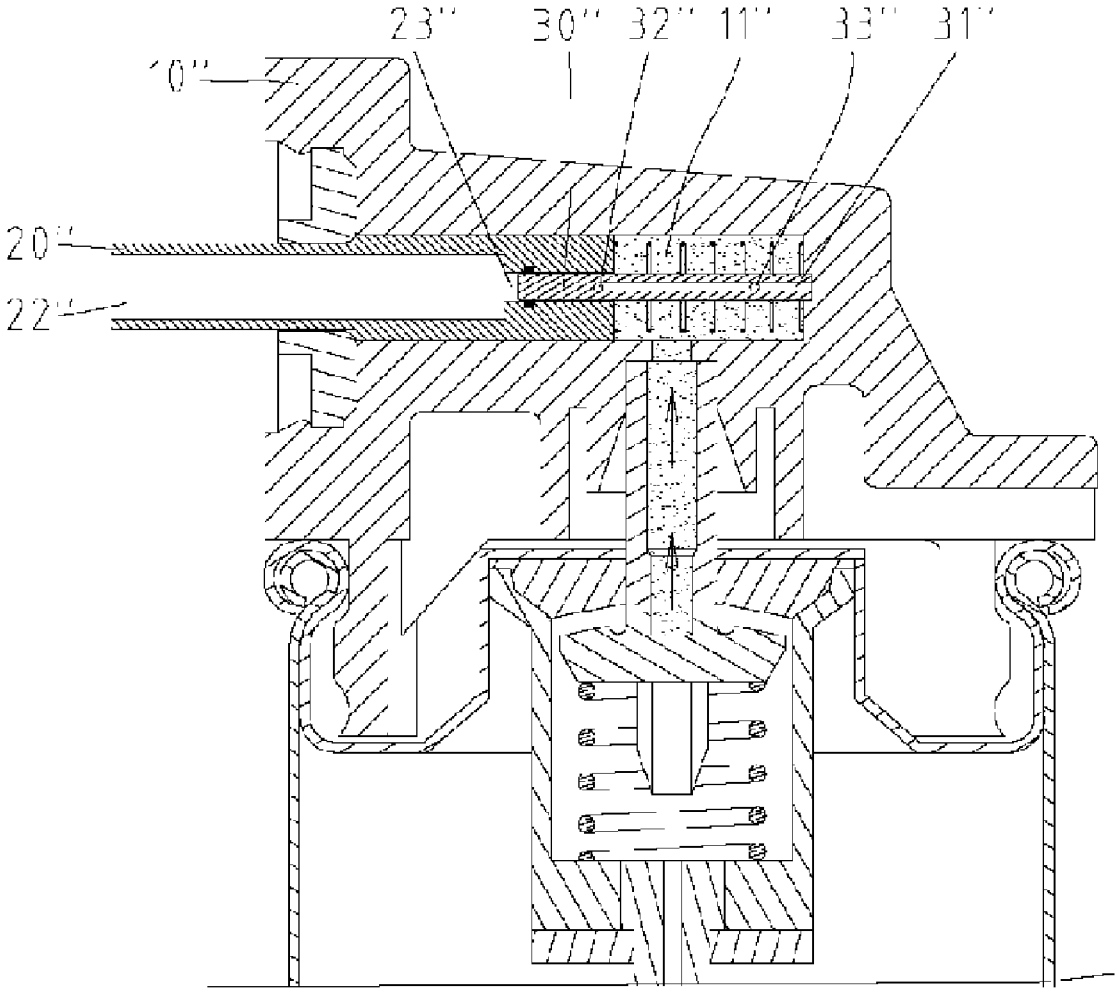
Fig.10 PRIOR ART
FIG. 10 is a cross-sectional view of another conventional valve for a gas can.
Figure 11:
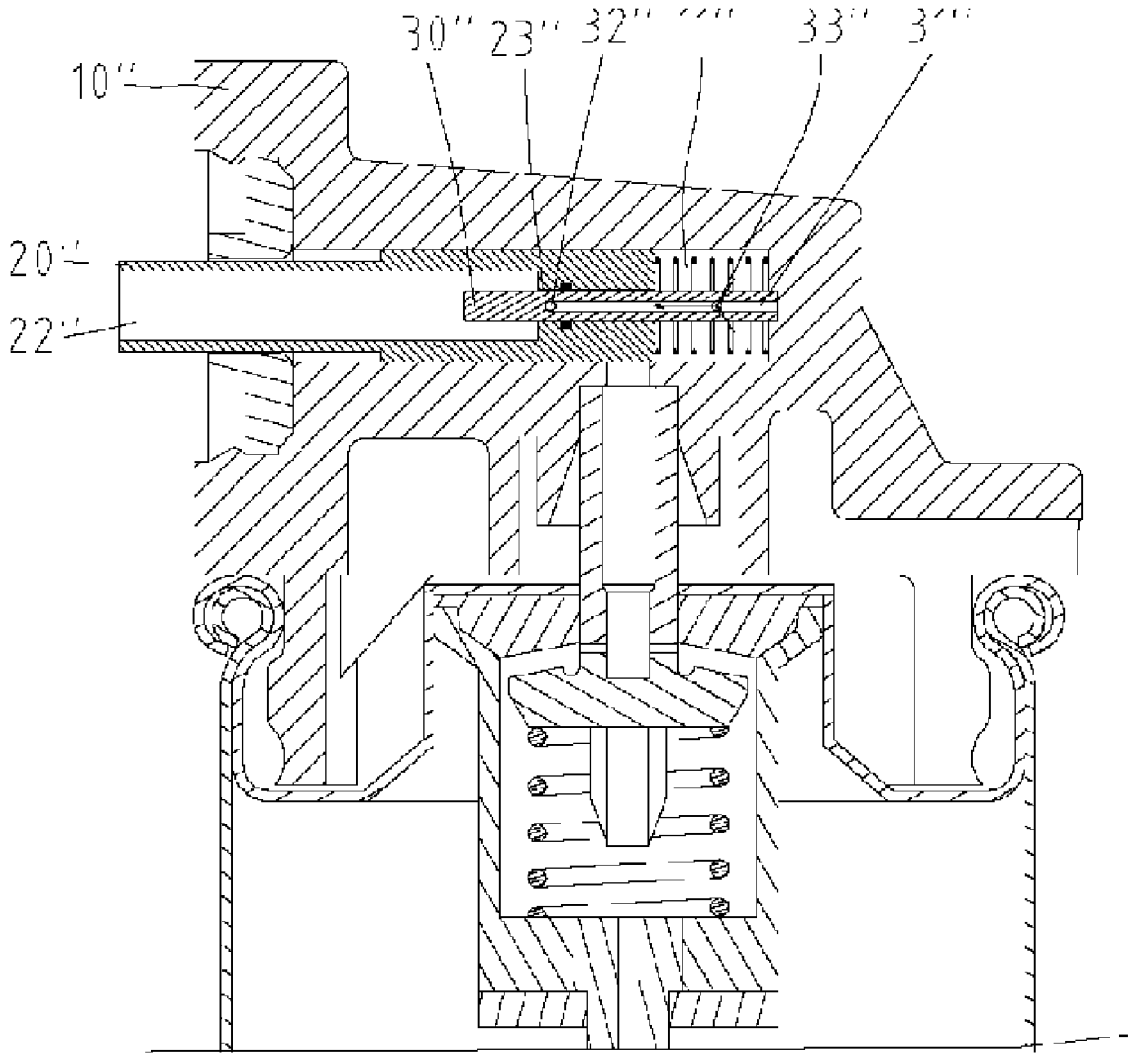
Fig.11 PRIOR ART
FIG. 11 is a cross-sectional view of the valve taken in another position than shown in FIG. 10.

Referring to FIG. 7, the second section 23 of the tube 20 is released so as to allow the movement of the first section 21 of the tube 20 from the rod 14 due to the spring 30 compressed between the external annular flange 27 and the shoulder formed between the subspaces 15 and 14 of the shell 10. The ball 42 abuts the internal annular flange 24 again so as to block the tunnel 22 of the tube 20. At this instant, the aperture 13 is open so as to allow gas to go into the first subspace 14 of the shell 10 from the gas can 90.

The valve of the present invention exhibits some advantages. Firstly, it precisely provides a predetermined amount of gas every time the tube is pushed to the second position. Secondly, it can easily be made.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A valve comprising:

a shell defining a space and an aperture through which gas can go into the space;

a tube being movable in the space of the shell between a first position for opening the aperture of the shell and a second position for closing the aperture of the shell, the tube comprising a tunnel therein and an internal annular flange on the wall of the tunnel;

at least one annular seal located between the tube and the shell;

a spring compressed between the tube and the shell;

a core located in the tube so as to abut the internal annular flange of the tube in the first position of the tube; and a rod formed on a closed end of the space of the shell so as to push the core from the internal annular flange of the tube in the second position of the tube.

2. The valve according to claim 1 wherein the core comprises a ball for abutment against the internal annular flange of the tube and a spring for pushing the ball to the internal annular flange of the tube.

3. The valve according to claim 2 wherein the ball is connected to the spring of the core.

4. The valve according to claim 2 comprising an annular restraint for restraining the core in the tunnel of the tube, wherein the spring of the core is compressed between the ball and the annular restraint.

5. The valve according to claim 4 wherein the tube defines an annular groove on the wall of the tunnel so as to receive the annular restraint.

6. The valve according to claim 1 wherein the space of the shell is divided into a first subspace for receiving the seal and a second subspace for receiving the spring.

7. The valve according to claim 6 wherein the diameter of the first subspace is smaller than that of the second subspace.

8. The valve according to claim 7 wherein the tube comprises an external annular flange formed thereon, wherein the spring is compressed between the external annular flange of the tube and a shoulder formed between the first and second subspaces of the shell.

9. The valve according to claim 1 wherein the core comprises a ball for abutment against the internal annular flange of the tube and a spring for pushing the ball to the internal annular flange of the tube.

10. The valve according to claim 9 wherein the ball is connected to the spring of the core.

11. The valve according to claim 9 comprising an annular restraint for restraining the core in the tunnel of the tube, wherein the spring of the core is compressed between the ball and the annular restraint.

12. The valve according to claim 11 wherein the tube defines an annular groove on the wall of the tunnel so as to receive the annular restraint.

13. The valve according to claim 1 comprising an annular restraint for restraining the tube and the spring in the space of the shell.

14. The valve according to claim 13 comprising an annular seal positioned against the annular restraint so as to seal the space of the shell.

15. The valve according to claim 14 comprising a washer positioned between the seal and the annular restraint.

16. The valve according to claim 1 wherein the shell comprises an insert for fitting in a tubular portion of the gas can.

* * * * *